US007980411B2

(12) United States Patent
Kasbohm

(10) Patent No.: US 7,980,411 B2
(45) Date of Patent: Jul. 19, 2011

(54) APPARATUS FOR SECURING A BAG WITHIN A CONTAINER WITH SCENTED RETAINING ELEMENT

(75) Inventor: Michael Kasbohm, Eden Prairie, MN (US)

(73) Assignee: SpecTech, Inc., Minneapolis, MN (US)

( * ) Notice: Subject to any disclaimer, the term of this patent is extended or adjusted under 35 U.S.C. 154(b) by 1121 days.

(21) Appl. No.: 11/789,286

(22) Filed: Apr. 23, 2007

(65) Prior Publication Data

US 2008/0256759 A1 Oct. 23, 2008

(51) Int. Cl.
*B65F 1/06* (2006.01)

(52) U.S. Cl. ..... 220/495.11; 220/495.08; 220/908.1

(58) Field of Classification Search ..... 220/908.1, 220/908, 495.11, 495.08; 248/95, 99, 100, 248/101

See application file for complete search history.

(56) References Cited

U.S. PATENT DOCUMENTS

| | | | | | |
|---|---|---|---|---|---|
| 981,639 | A | * | 1/1911 | Hall | 248/100 |
| 4,349,104 | A | | 9/1982 | Hayes | |
| 4,418,835 | A | * | 12/1983 | Watts | 220/495.1 |
| 4,874,129 | A | | 10/1989 | DiSapio et al. | |
| 4,919,374 | A | * | 4/1990 | Julian | 248/95 |
| 5,119,968 | A | | 6/1992 | Palmer | |
| 5,174,462 | A | | 12/1992 | Hames | |
| 5,611,507 | A | | 3/1997 | Smith | |
| 5,645,186 | A | | 7/1997 | Powers | |
| 5,695,088 | A | | 12/1997 | Kasbohm | |
| 5,735,495 | A | | 4/1998 | Kubota | |
| 5,887,748 | A | | 3/1999 | Nguyen | |
| 5,911,335 | A | | 6/1999 | Baumann | |
| 5,947,295 | A | | 9/1999 | Lutin | |
| 5,987,708 | A | | 11/1999 | Newton | |
| 5,997,178 | A | | 12/1999 | Nye et al. | |
| 6,000,571 | A | | 12/1999 | Brooks et al. | |
| 6,123,906 | A | * | 9/2000 | Farmer | 422/124 |
| 6,176,455 | B1 | | 1/2001 | Ma | |
| 6,286,706 | B1 | | 9/2001 | Tucker | |
| 6,554,151 | B1 | | 4/2003 | Brennen | |
| 6,557,716 | B1 | | 5/2003 | Chan | |
| 6,604,717 | B2 | | 8/2003 | Stanfield | |
| 6,705,575 | B1 | | 3/2004 | Hoy | |
| 6,728,996 | B2 | | 5/2004 | Roscow | |
| 6,918,505 | B2 | | 7/2005 | Gifford, Sr. | |
| 7,086,569 | B2 | | 8/2006 | Stravitz | |
| 7,100,767 | B2 | | 9/2006 | Chomik et al. | |
| 2004/0156564 | A1 | * | 8/2004 | Glasser | 383/72 |
| 2005/0205579 | A1 | | 9/2005 | Buchalter et al. | |
| 2006/0096988 | A1 | | 5/2006 | Kim | |

OTHER PUBLICATIONS http://www.rubbermaidbrute.com/rcp/micro/brute/en/, 2007 Rubbermaid Commercial Products.

* cited by examiner

*Primary Examiner* — Stephen Castellano
(74) *Attorney, Agent, or Firm* — Schroeder & Siegfried, PA

(57) ABSTRACT

An apparatus for securing a trash bag in a container is disclosed, where the apparatus has a removable and replaceable scented bag retaining element which extends outwardly from the main body of the apparatus. The main body has a pair of spaced channel arms that receive, guide and support the retaining element in proper position against the main body, and the replaceable scented retaining element has a releasable locking tab which is received by and locks within a slot in the main body of the apparatus. A central membrane of the retaining element has a number of slits that form a number of flexible flaps which deform when pressed to received and retain the trash bag. The main body is adhesively mountable to the outer surface of the container.

18 Claims, 3 Drawing Sheets

APPARATUS FOR SECURING A BAG WITHIN A CONTAINER WITH SCENTED RETAINING ELEMENT

BACKGROUND OF THE INVENTION

The present invention relates generally to an apparatus for securing a bag or liner in a container. More particularly, the present invention is directed to an apparatus that includes a replaceable scented retainer element which serves the dual function of: (1) maintaining the bag secured around the rim of a container; and (2) masking any malodor associated or generated by the contents of the container. The bag retaining apparatus is secured to the container and prevents the mess and hassle that occurs when a bag falls into the container.

Containers, such as waste receptacles for disposing of trash, come in a variety of sizes. Garbage bags or container liners used in such receptacles also come in a variety of sizes, and use of a bag that is not properly sized for the container will oftentimes result in a mess. If the bag fails to properly secure around the outside rim of the container, garbage will spill out, causing the outside of the bag or container to become soiled with unpleasant and offensive smelling waste. An additional mess often ensues when one has to reach inside the container full of garbage to retrieve the top of the bag. Not only do the hands get dirty, clothing may get soiled and garbage is oftentimes spilled. If the bag to be used is much larger than the container, there is a large amount of excess bag hanging outside of the container. Such excess baggage is not only unsightly and cumbersome to handle, but is also wasteful, costly and ultimately harmful to the environment. Even when a bag is the correct size for the trash container, the bag sometimes falls into the container when garbage is dropped in. This results in waste being dumped directly into the unlined container, further causing the container to become caked with an unsanitary and noxious residue.

Another problem is; the constant presence of malodor generated by the waste in trash containers. Whether caused by the trash contained within the trash liner, or the residue left in, on or around the container, the offensive and oftentimes noxious odor can permeate the surrounding areas where the containers are kept. While covering the container is helpful in containing the spread of such malodor, the covers are often designed to be loose-fitting, or are discarded altogether for ease of handling and disposing of trash. Moreover, any spillage or leftover residue of waste on the container will continue to ferment and cause unpleasant malodor.

Many remedies have been previously presented in an attempt to cover up or eliminate the presence of malodor associated with trash containers. In some waste receptacles, deodorizing scent dispensers have been secured to the base or covers of the containers to help mask the unpleasant odor. In others, the liners themselves are designed with fragrance-emitting strips or other means incorporated therein. In still another known device, a liner dispenser is secured to the base of the container which is optionally scented. While these devices have all been reasonably successful in helping to mask malodor, none address the underlining problem of spillage which is oftentimes the cause of the malodor.

Remedies have also been attempted to prevent spillage of waste by better securing the trash bags in the waste receptacles, but none have heretofore sought to address the continuing presence of the malodor caused by the trash. For instance, one such remedy has been to tape the trash bags to the container. This is very time-consuming and offers no solution to the malodor created by the waste. Moreover, the tape is typically not reusable, and oftentimes results in ripping the bag when it is time to remove the tape to empty the container. Another attempted remedy is to tie the bag when there is an excess amount of baggage hanging over the rim. Still another is to secure the bag to the container using a large elastic band extending, therearound. Again, these remedies do not address the issue of the noxious odors created by the waste. Also, these are sometimes daunting tasks for people with arthritic conditions or for kids, whose chores often include taking out the garbage.

A more recent remedy which solves many of the above problems is the use of a liner cinch similar to that found in my earlier U.S. Pat. No. 5,695,088, the contents of which are incorporated herein by reference thereto. He re again, however, the means provided for securing the trash liner to the rim of the trash container does not incorporate or contemplate any means for addressing the issue of malodor created by the waste being disposed of. Other holding devices for securing such container liners in waste receptacles can also be found in U.S. Pat. Nos. 5,645,186; 5,911,335; 5,987,708; 6,286,706 and 6,606,717, but none of these devices provide any mechanism for addressing the continuing presence of the offensive malodor associated with the trash.

While separate remedies for the problems of waste spillage and the associated malodor are available, incorporating such conventional remedies obviously requires timely and costly use of multiple spill prevention and malodor devices, or separate methods to address these problems; this is extremely inefficient. Hence, it is evident that there is a distinct need for a low-cost, efficient and easy-to-use alternative which will simultaneously address both the underlying problems of waste spillage and the offensive and unpleasant malodor associated therewith. It is with this in mind that I have developed the present invention as hereafter described and claimed.

BRIEF SUMMARY OF THE INVENTION

The present invention is designed to overcome the above problems associated with container liner bags using a single, low-cost and easy-to-use apparatus which will simultaneously maintain the bag secured around the rim of the container, and mask any malodor associated or generated by the contents of the container. The present invention comprises an apparatus for securing a trash bag in a container where at least a portion of the apparatus constitutes a removable and replaceable scented bag retaining element. Although it is contemplated that the entire apparatus may be constructed as such, in one preferred embodiment, the apparatus includes a main body member that is mountable on an outer surface of the container, and a separate removable and replaceable scented retaining element. In this embodiment, the main body member has a pair of outwardly extending spaced arms which form a pair of channel members. These channel members are designed to receive and guide the replaceable scented retaining element into proper supported position against the main body member of the apparatus.

The replaceable scented retaining element is preferably constructed of a fragrance-emitting plastic material, such as a scent-impregnated polyethylene. It has a releasable locking tab which is received by and locks within a slot formed in the main body of the apparatus. The outer edge portions of the retaining element are slidably received and guided by the channeled arms of the main body member to cause the locking tab of the retaining element to engage the main body member in releasable locking relation. The retaining element further includes a central membrane which has a number of generally radially extending slits formed therein. These slits define a plurality of flexible flaps juxtaposed in closely adjacent relation which, when depressed, are designed to receive and retain a portion of a trash bag being pushed therethrough.

A trash bag is preferably secured by adhesively mounting the main body member of the apparatus to the outside wall of a container, although the main body could be formed as a part of the container, and other means of attachment are also contemplated. With a retaining element of desired fragrance properly locked in place, the bag is then placed in the container and a small section of the top of the bag is pushed through the opening in the membrane formed by the slits. The bag is then fit around the entire rim of the container. Finally, more of the bag is pulled through the membrane until the bag is tight around the container. The bag is now held secure by the flaps of the membrane. Depending on the desire or need to replace an existing retaining element with one having a new or fresher scent, the locking tab may be readily released with a relatively light pulling force, and the retaining element removed. Once removed, the old retaining element may simply be disposed of and replaced with a new one.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1:
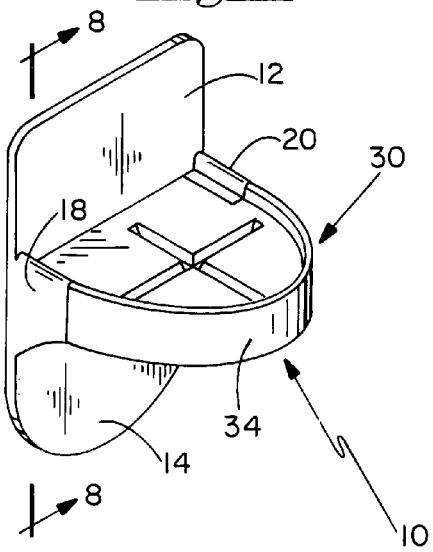
FIG. 1 is a perspective view of an apparatus according to the present invention as seen from the top front.
Figure 2:
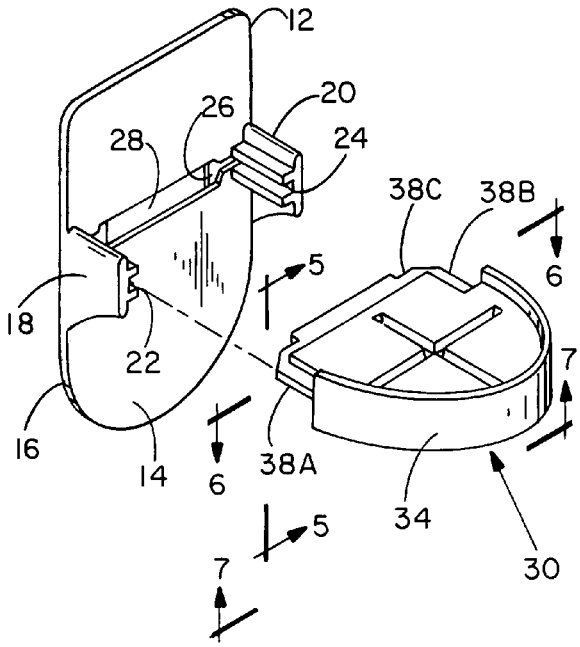
FIG. 2 is an exploded perspective view of the apparatus of FIG. 1, showing the removable retaining element thereof.

FIG. 1 illustrates an apparatus 10 for securing a bag in a container made according to the present invention. The apparatus 10 generally includes a main body member 12, a retaining element 30 having a central membrane 32 (seen in FIG. 6), and a mounting member 60 (seen in FIG. 4). As discussed in detail hereafter, at least a portion of the apparatus 10 is constructed to emit a pleasant scent to help mask malodor typically associated with trash receptacles. Although it is certainly contemplated that the entire apparatus 10 could be constructed as a readily replaceable scented one-piece unit, in the preferred embodiment, as shown in FIG. 2, the main body member 12 and retaining element 30 are constructed as separate elements, at least a portion of which is constructed of a scent-emitting material.

Figure 4:
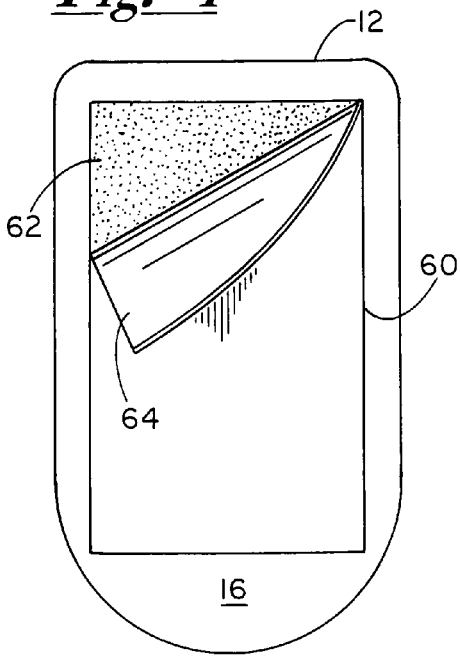
FIG. 4 is a rear elevational view of the main body member of the apparatus of FIG. 1, showing the preferred form of adhesive mounting thereof.

As shown, the main body member 12 has a front surface 14 and a back surface 16 (seen in FIG. 4). In the preferred embodiment, the main body member 12 is approximately 40.0 mm wide, 70.0 mm tall, and 1.5-2.0 mm thick, but these dimensions could be changed without departing from the spirit of the invention. As seen best in FIG. 2, a pair of spaced arms 18 and 20, which function to support the retaining element 30 when engaged, extend outwardly from the front surface 16 of the main body member 12.

Figure 3:
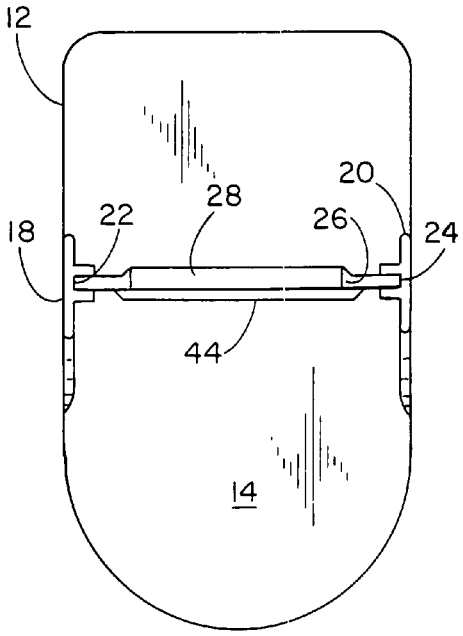
FIG. 3 is a front elevational view of the main body member of the apparatus of FIG. 1.

Arms 18 and 20 form respective guide channels 22 and 24 that act to receive and guide the retaining element 30 into proper engaging position relative to the main body member 12. As shown in FIGS. 2 and 3, the main body member 12 also includes a recess 26 with a central slot opening 28 that provides additional support and means for releasably locking the retaining element 30 thereto, as will be discuss in further detail below. While not specifically shown, it is noted that an additional supporting means similar to arms 18 and 20 could also be provided for carrying some form of a separate disinfecting means, such as an ant-bacterial, anti-fungal or anti-mold agent.

In the preferred embodiment, the main body member 12 and retaining element 30 of apparatus 10 are each separately manufactured as a one-piece injection-molded unit made of plastic. The main body member 12 is preferably constructed of a relatively rigid plastic, such as polypropylene or ABS plastic. The retaining element 30, on the other hand, is preferably constructed of a softer, more flexible low density polyethylene, or other flexible plastic or blend thereof, to enhance its flexibility and longevity during extended use. While some form of plastic is the preferred material of manufacture, it is certainly possible that one or more of the various components of the present invention could be made with other materials such as fiberglass, wood or metal without departing from the spirit of the invention.

The retaining element 30 shown in FIG. 2 is constructed to be readily removable from the main body member 12. Preferably, at least the retaining element 30 is constructed from a plastic material which is impregnated upon manufacture with a masking fragrance. This is accomplished by incorporating a scent additive in bead or liquid form directly into the base resin of the plastic material as it is prepared. Depending on the desired strength and longevity of the scent, the material let-down ratio (i.e., percentage by weight of scent additive to polyethylene) may be adjusted accordingly. It is contemplated that a let-down ratio between the approximate range of 1% and 10% should be adequate for most applications.

As seen in FIG. 1, the retaining element 30 extends substantially perpendicular from the front surface 14 of the main body member 12 when connected therewith. The retaining element 30 extends across the entire width of the main body member 12 and extends out approximately 38.0 mm. The retaining element 30 extends from the main body member 12 approximately one-third (⅓) of the way down from the top thereof. In the preferred embodiment shown, the retaining element 30 is generally semi-circular in shape, but could also be rectangular, octagonal, or many other shapes without departing from the spirit of the invention. Other than the central membrane 32, which will be discuss in more detail later, the major portion of the retaining element 30 is approximately 3.0-4.0 mm thick, which gives it some rigidity. For additional support and rigidity, an outer rail 34 extends around the peripheral edge of the retaining element 30, and abuts with arms 18 and 20 of the main body member 12 when connected thereto.

Figure 5:
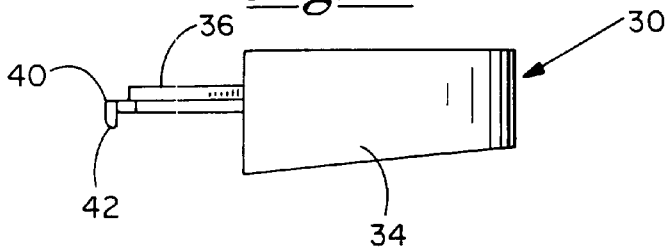
FIG. 5 is a side elevational view of the removable retaining element of the apparatus of FIG. 1.
Figure 6:
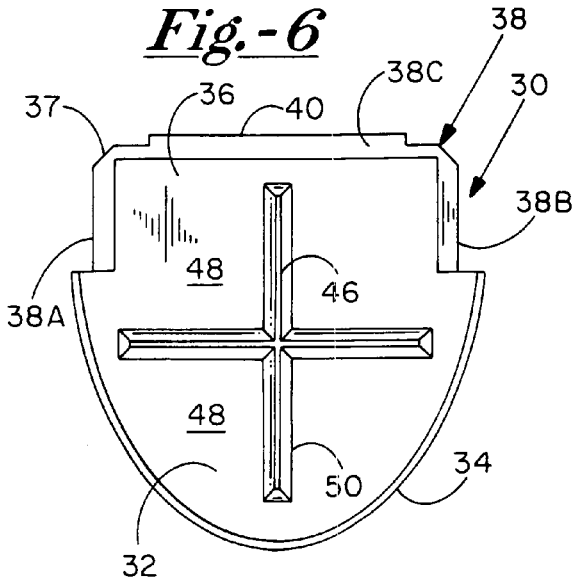
FIG. 6 is a top plan view of the removable retaining element of the apparatus of FIG. 1.
Figure 7:
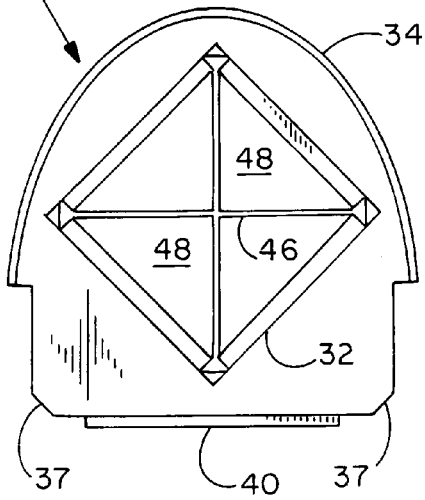
FIG. 7 is a bottom plan view of the removable retaining element of the apparatus of FIG. 1.

As shown best in FIGS. 5 and 6, the end portion 36 of retaining element 30 which engages and connects to the main body member 12 has a peripheral shoulder 38 comprising opposite side shoulder elements 38A and 38B, and end shoulder element 38C. In the preferred embodiment shown, shoulder 38 has a reduced thickness approximating 1.5 mm, which is just slightly less than the width of guide channels 22 and 24. This facilitates slidable insertion of side shoulder elements 38A and 38B within respective guide channels 22 and 24 for proper positioning and connection to the main body member 12. To further facilitate insertion of side shoulder elements 38A and 38B within respective guide channels 22 and 24, as shown in FIGS. 6 and 7, shoulder corners 37 are tapered toward end shoulder element 38C.

Figure 8:
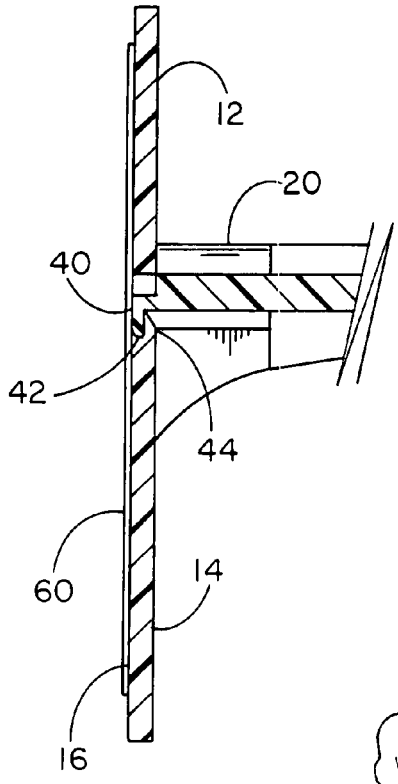
FIG. 8 is a vertical cross sectional view taken along lines 8-8 of the apparatus of FIG. 1.

As seen in FIGS. 5 and 8, a generally L-shaped locking tab 40 extends outwardly and downwardly from the end shoulder element 38C. The end 42 of locking tab 40 is radiused to facilitate ease of engagement with main body member 12 for locking thereto. To further facilitate ease of engagement, the lower edge 44 of slot 28 that is engaged by end 42 of the locking tab 40 during insertion is also beveled.

As shown best in FIG. 2, in order to connect the scented retaining element 30 to the main body member 12, the side shoulder elements 38A and 38B of the retaining element 30 are inserted within the respective channels 22 and 24 of arms 18 and 20 of the main body member 12. Shoulder elements 38A and 38B are slid inwardly toward the main body member 12 until the end shoulder element 38C is received within recess 26 and the locking tab 40 enters the open slot 28 in the main body member 12. The L-shaped locking tab 40 then engages the edge 44 of slot 28 and snaps into locking engagement therewith, as shown in FIG. 8. It will be appreciated that, while the above describes the preferred construction for engaging and locking the retaining element 30 to the main body member 12, other means of interlocking such members are available without departing from the invention herein. For instance, it is contemplated that the retaining element 30 could alternatively be designed with a pair of spring-loaded locking arms designed to lockably engage the main body member 12.

In the preferred embodiment shown, the scented retaining element 30 may be removed for replacement by simply pulling it outward from the main body member 12, which will cause the locking tab 40 to flex upwardly and become disengaged from the edge 44 of slot 28. Alternatively, while pulling outward on retaining element 30, one may also apply light upward pressure against the end portion 36 of the retaining element 30, so is to help urge the locking tab 40 up and over edge 44. Therefore, depending on the desire or need to replace an existing retaining element with one having a new or fresher scent, the locking tab 40 may be readily released with a relatively light pulling force, and the retaining element 30 removed. Once removed, the old retaining element may simply be disposed of and replaced with a new one.

As shown best in FIGS. 6 and 7, the retaining element 30 includes central membrane 32 which is designed for receiving and securing the bag. In the preferred embodiment shown, the central membrane 32 is a rectangular membrane, but it is certainly contemplated that it may take on other configurations without departing from the invention herein. A plurality of slits 46 are provided in the central membrane 32 which dissect the membrane 32 into four substantially equal generally triangular-shaped flaps 48. The central membrane 32 is preferably made of the same material as the rest of the retaining element 30, but is somewhat thinner than its surrounding portions to allow the flaps 48 to be more easily deformed for receiving and retaining the bag. In the preferred embodiment, the central membrane 32 is approximately 1.0 mm thick, as opposed to the 3.0-4.0 mm thickness of the remainder of retaining element 30. As can be seen in FIG. 6, the flaps 48 are beveled downward toward the slits 46 at their outermost edges 50. The beveled edges 50 encourage and assist the trash bag through the opening created in membrane 32 when the flaps 48 are depressed.

As can be seen in FIG. 4, secured to the back surface 16 of the main body member 12 is a mounting member 60. In the preferred embodiment illustrated, the mounting member 60 is an adhesive two sided tape 62 which is designed to adhere to numerous surfaces, such as plastic and rubber from which trash containers are typically made. A protective adhesive release strip 64 is carried by and should be removed from the mounting member 60 prior to it being adhered to a container. It should be noted that other means for mounting the main body member 12 could also be used without departing from the invention herein. For instance, the main body member could be formed integrally with the container. Alternatively, a pair of small screws could be attached to the apparatus 10 for fastening to the container, or it could be sonic welded, riveted or secured by other relatively permanent means to the container.

Figure 9:
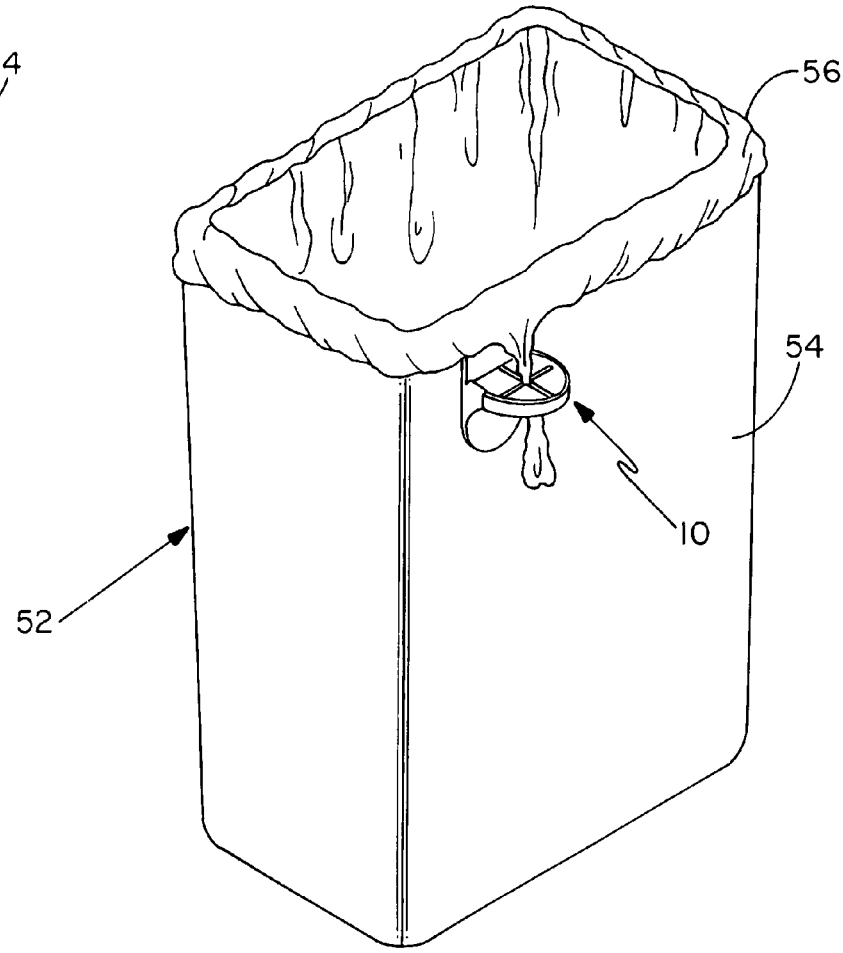
FIG. 9 is a perspective view of a bag secured within a container by the apparatus of FIG. 1.

FIG. 9 illustrates the manner in which the bag retaining apparatus 10 of the present invention may be utilized with an exemplary waste container 52. The waste container 52 has a plurality of side walls 54 and an upper rim (not seen) connecting the side walls. By removing the adhesive release strip 64 from the mounting member 60, the apparatus 10 may be adhered to the outside of one of the side walls 54 of the container 52, preferably near its upper rim. A scented retaining element 30 of desired fragrance may be properly locked in place against the main body member 12 either before or after securing the apparatus to the container 52.

Once the apparatus 10 has been secured to the container 52, a plastic bag 56 is provided and placed into the container 52. A small portion of the bag 56 is then pushed through the central membrane 32 of the retaining element 30 by displacing the flaps 48. The displacement of the flaps 48 is made easier due to their relative thinness. The bag 56 is then fit around the entire rim of the container 52. Once this is done, more of the bag 56 is pulled through the membrane 32 until the bag 56 is tight around the rim of the container 52. The bag is now secured in the container. Since the retaining element 30 is readily removable, it may be replaced at any time with a new one, depending on the desire or need for a new or fresher scent.

As is evident from the above, the present invention provides a low-cost, efficient and easy-to-use apparatus which will simultaneously address both the underlying problems of waste spillage and the offensive and unpleasant malodor associated therewith. Given the low cost to manufacture the scented retaining element 30, the entire unit is disposable, and once the intensity of the fragrance emitted therefrom wears off and decreases to an unacceptable level, it may simply be removed and replaced with a new one.

It will, of course, be understood that various changes may be made in the form, details, arrangement and proportions of the parts without departing from the scope of the invention which comprises the matter shown and described herein and set forth in the appended claims.

The invention claimed is:

1. An apparatus for securing a bag in a container, comprising:

(a) a container;

(b) a main body member being mountable on said container;

(c) a scented bag retaining element being connectable to said main body member in readily releasable locking engagement thereto; and (d) said main body member including a pair of spaced arms constructed to engage and support said retaining element, wherein each of said arms of said main body member is constructed as a channel member adapted to receive an edge portion of said bag retaining element.

2. An apparatus for securing a bag in a container, comprising:

(a) a container;

(b) a main body member;

(c) a mounting member for securing said main body member to said container;

(d) a scented bag retaining element being constructed as a one-piece disposable unit and being connectable to said main body member for direct engagement and securement of the bag to said container;

(e) said retaining element being connectable to said main body member in readily releasable locking engagement thereto to facilitate rapid removal and disposal of said retaining element when desired; and (f) said scented retaining element being constructed of a softer, more flexible material than said main body member.

3. The apparatus defined in claim 2, wherein said scented retaining element is constructed of a scent-impregnated plastic material.

4. The apparatus defined in claim 2, wherein said scented retaining element is constructed of fragrance-impregnated polyethylene.

5. The apparatus defined in claim 2, wherein said scented retaining element includes a locking tab which is received in locking engagement by said main body member.

6. The apparatus defined in claim 5, wherein said main body member includes opening-defining portions which define a slot for receiving said locking tab in locking engagement.

7. The apparatus defined in claim 6, wherein said opening-defining portions include a beveled edge section which facilitates receipt of said locking tab in said slot for locking engagement with said main body member.

8. The apparatus defined in claim 2, wherein said mounting member for securing said main body member to said container is comprised of an adhesive.

9. The apparatus defined in claim 2, wherein said retaining element extends outwardly from said main body member and said main body member includes a pair of spaced arms constructed to engage and support said retaining element.

10. The apparatus defined in claim 9, wherein each of said arms of said main body member are constructed as a channel member adapted to receive an edge portion of said retaining element.

11. The apparatus defined in claim 2, wherein said bag retaining element includes a flexible membrane, said membrane having a plurality of slits that define a plurality of flexible flaps therein for receiving and securing the bag, each of said flaps having a first edge and a second edge wherein said first edge of each said flap is immediately adjacent said second edge of an adjacent said flap, and each of said flaps having a vertex wherein the vertex of each said flap is immediately adjacent the vertex of all other said flaps.

12. The apparatus defined in claim 11, wherein said first and second edges of said flaps have a beveled shape to encourage the bag through said slits in one direction and to prevent the bag from escaping said slits in the opposite direction.

13. The apparatus defined in claim 2, wherein said bag retaining element is constructed of a scent-impregnated plastic material having a let-down ratio within the approximate range of 1.0-10.0 percent.

14. The apparatus defined in claim 2, wherein said main body member includes a pair of spaced arms extending outwardly therefrom which are configured as channel members and adapted to slidably receive and engage said bag retaining element in supporting relation.

15. The apparatus defined in claim 2, wherein said bag retaining element includes a central membrane, said central membrane having a plurality of slits that define a plurality of flexible flaps therein for receiving and securing the bag.

16. The apparatus defined in claim 2, wherein each of said flaps has a first edge and a second edge, said first edge of each of said flaps being immediately adjacent said second edge of an adjacent said flap, and each of said flaps having a vertex wherein the vertex of each said flap is immediately adjacent the vertex of all other said flaps.

17. An apparatus for securing a bag in a container, comprising:

(a) a container;

(b) a bag retaining member securable on a surface of said container and extending outwardly therefrom, said bag retaining member being constructed to receive and secure a portion of the bag;

(c) said bag retaining member including a main body portion and a retaining element, said retaining element being removable from said main body portion;

(d) said removable retaining element including a locking tab which is received in locking engagement by said main body portion of said bag retaining member;

(e) said main body portion of said bag retaining member including opening-defining portions which define a slot for receiving said locking tab in locking engagement;

(f) said opening-defining portions including a beveled edge section which facilitates receipt of said locking tab in said slot for locking engagement with said main body portion of said bag retaining member; and (g) at least a portion of said bag retaining member being constructed to emit a scent.

18. An apparatus for securing a bag in a container, comprising:

(a) a container;

(b) a bag retaining member securable on a surface of said container and extending outwardly therefrom, said bag retaining member being constructed to receive and secure a portion of the bag;

(c) said bag retaining member including a main body portion and a retaining element, said retaining element being removable from said main body portion;

(d) said retaining element extending outwardly from said main body portion and said main body portion including a pair of spaced arms constructed to engage and support said retaining element;

(e) each of said arms of said main body portion being constructed as a channel member adapted to receive an edge portion of said retaining element; and (f) at least a portion of said bag retaining member being constructed to emit a scent.

* * * * *